United States Patent [19]

Reuter

[11] Patent Number: 4,716,868

[45] Date of Patent: Jan. 5, 1988

[54] HAND STARTER CRANK WITH INTEGRATED SAFETY DEVICE

[75] Inventor: Harald Reuter, Cologne, Fed. Rep. of Germany

[73] Assignee: Kloeckner-Humboldt-Deutz AG, Fed. Rep. of Germany

[21] Appl. No.: 908,267

[22] Filed: Sep. 17, 1986

[30] Foreign Application Priority Data

Sep. 21, 1985 [DE] Fed. Rep. of Germany ..... 3533685

[51] Int. Cl.[4] ..... F02N 1/02

[52] U.S. Cl. ..... 123/185 S; 74/6

[58] Field of Search ..... 123/185 P, 185 S, 185 C; 74/6

[56] References Cited

U.S. PATENT DOCUMENTS

| | | | |
|---|---|---|---|
| 986,221 | 3/1911 | Saeger et al. | 123/185 S |
| 1,356,876 | 10/1920 | Morton et al. | 123/185 S |
| 1,440,311 | 12/1922 | Munters | 123/185 S |
| 1,911,113 | 5/1933 | Fry | 123/185 S |
| 4,556,021 | 12/1985 | Anetzberger et al. | 123/185 S |

*Primary Examiner*—Andrew M. Dolinar
*Attorney, Agent, or Firm*—Charles L. Schwab

[57] ABSTRACT

A manual starter crank has an integrated safety device providing protection against backfiring during starting of an internal combustion engine. The manual starter crank has a starter shaft which, when turning in a starting direction, engages the free end of a cam shaft of the internal combustion engine. The safety device is integrated into the casing of the manual starter crank and includes a ratchet with a pivot axis which is approximately parallel to the starter shaft. In the engaged position of the ratchet, a free end thereof engages an abutment surface on the starter shaft, whereby the manual starter crank is connected in torque transmitting relation with the engine cam shaft when the crank is turned in a starting direction. The safety device includes a disengaging bushing surrounding the starter shaft and which is mounted on a bearing support by a one-way clutch and presents a disengaging pin in the path of movement of the ratchet. The disengaging pin cooperates with the ratchet to move it to a disengaged position during backfiring of the engine.

16 Claims, 3 Drawing Figures

HAND STARTER CRANK WITH INTEGRATED SAFETY DEVICE

TECHNICAL FIELD

This invention relates to a manual starter crank with an integrated safety device affording protection in event of a kickback during starting an internal combustion engine.

PRIOR ART STATEMENT

U.S.Pat. No. 4,556,021 shows and describes a manual starter crank with a built-in safety device in which the end of the ratchet remote from the part engaging the starter shaft coupler is extended by means of a laminated spring. The free end of the laminated spring engages indentations in the part of the rotatable crank handle which extends into the crank casing. During a cranking operation with this prior art crank, the handle rotates and causes the laminated spring to resiliently urge the ratchet into its locking position. In the event of a backfiring of the internal combustion engine with the manual starter crank engaged in an engine starting position and the handle gripped securely, the handle turns in such a way that the laminated spring is displaced in the direction of the nonengaged position of the ratchet and becomes disengaged from the indentation of the handle. A disengaging spring which biases the ratchet into its nonengaged position then causes the locking connection between the starter shaft and the manual starter crank to disengage. In order to disengage the ratchet, it is absolutely necessary that the person operating the engine maintains a secure grip on the handle so that a relative rotation is guaranteed between the handle and the casing of the manual starter crank, which induces the disengagement of the ratchet. If the operator lets go of the handle in reaction to the backfiring of the internal combustion engine, the manual starter crank, together with the cam shaft, rotates in the direction of the backfiring, without activating the safety device. This represents a considerable danger not only to the operator but to any nearby person as well because the detachable handle can shift from its support and be flung tangentially from its circular path of motion. Even when the operator does maintain a secure grip on the handle, he must contend with a considerable arc of rotation of the starter crank before the safety device is actuated. Since the force needed for disengagement varies according to the force generated by the backfiring, the disengagement force which is supplied by the disengaging spring must be dimensioned to correspond to the greatest possible backfiring in order to guarantee at all times that the disengagement force required to disengage the ratchet is available. In order to put this prior art manual starter equipment into operation, the ratchet must overcome the disengaging spring, which requires a considerable amount of force.

OBJECTS AND BRIEF SUMMARY OF THE INVENTION

The primary object of this invention is to provide a manual starter crank with an integrated safety device in which the safety device is operative even when the handle of the manual starter crank is let loose, and in which only a small force is required to reset the safety device.

It is a further object of this invention to provide a start crank safety device wherein disengagement of the torque transmitting ratchet occurs because of the force of backfiring of the internal combustion engine and therefore disengagement is directly dependent on the backfiring of the internal combustion engine. Thus even in the case of severe backfiring, the power necessary for disengagement of the ratchet is guaranteed.

It is a further object of this invention to provide a safety device which is not dependent on whether or not the operator maintains a firm grip on the handle of the manual starter crank during backfiring. If backfiring occurs when the manual starter crank is being rotated in a starting direction, the disengaging bushing is locked by a one-way clutch and the ratchet bears against the disengaging pin on the bushing and is displaced into its nonengaging position, whereby the manual starter crank is disengaged from the engine in the backfiring condition.

It is advantageous to have the disengaging pin maintained in engagement with the ratchet, at least when the ratchet is in its engaged position, so that the disengaging pin is always directly connected with the ratchet and in the event of a backfiring, will immediately bear against the ratchet, without lost motion, and shift it to its disengaged position. It is advantageous to provide the engagement in such a way that the disengaging pin is encompassed over 180° of its circumference by a recess in the ratchet.

Preferably, the crank includes a bearing support which fits into a housing part of the internal combustion engine so that the bearing support is properly supported and in the case of a lockup of the one-way clutch, the disengaging bushing with its disengaging pin is also properly supported.

A close fitting mounting is achieved by supporting the starter shaft in the bearing support, which guarantees that the starter shaft will be coaxial with the cam shaft. The bearing support serves, in addition, as a bearing for the crank casing.

Preferably, an oil feed opening is provided in the casing which can be closed by the handle when the latter is secured to the casing. In this way, oil can be injected into the inside of the casing, which will lubricate and preserve the individual elements of the safety device.

In addition, it is desirable to provide a safety actuator shiftable between cranking and noncranking positions which has a pin part in the path of movement of the ratchet in its cranking position, whereby it forms a stop for the ratchet when the latter is in its engaged position to ensure that the free end of the ratchet, which is adjacent to the abutment surface of the starter shaft, is always positioned a proper distance from the axis of rotation of the starter shaft. In its noncranking position, a stop flange of the safety actuator forms a stop for maintaining the ratchet in its disengaged position thereby preventing unintentional reconnecting of the ratchet with the starter shaft.

Preferably, the safety actuator is resiliently biased towards its noncranking position.

BRIEF DESCRIPTION OF THE DRAWINGS

One embodiment of the invention is illustrated in the drawings in which.

DETAILED DESCRIPTION OF THE DRAWINGS

Figure 1:
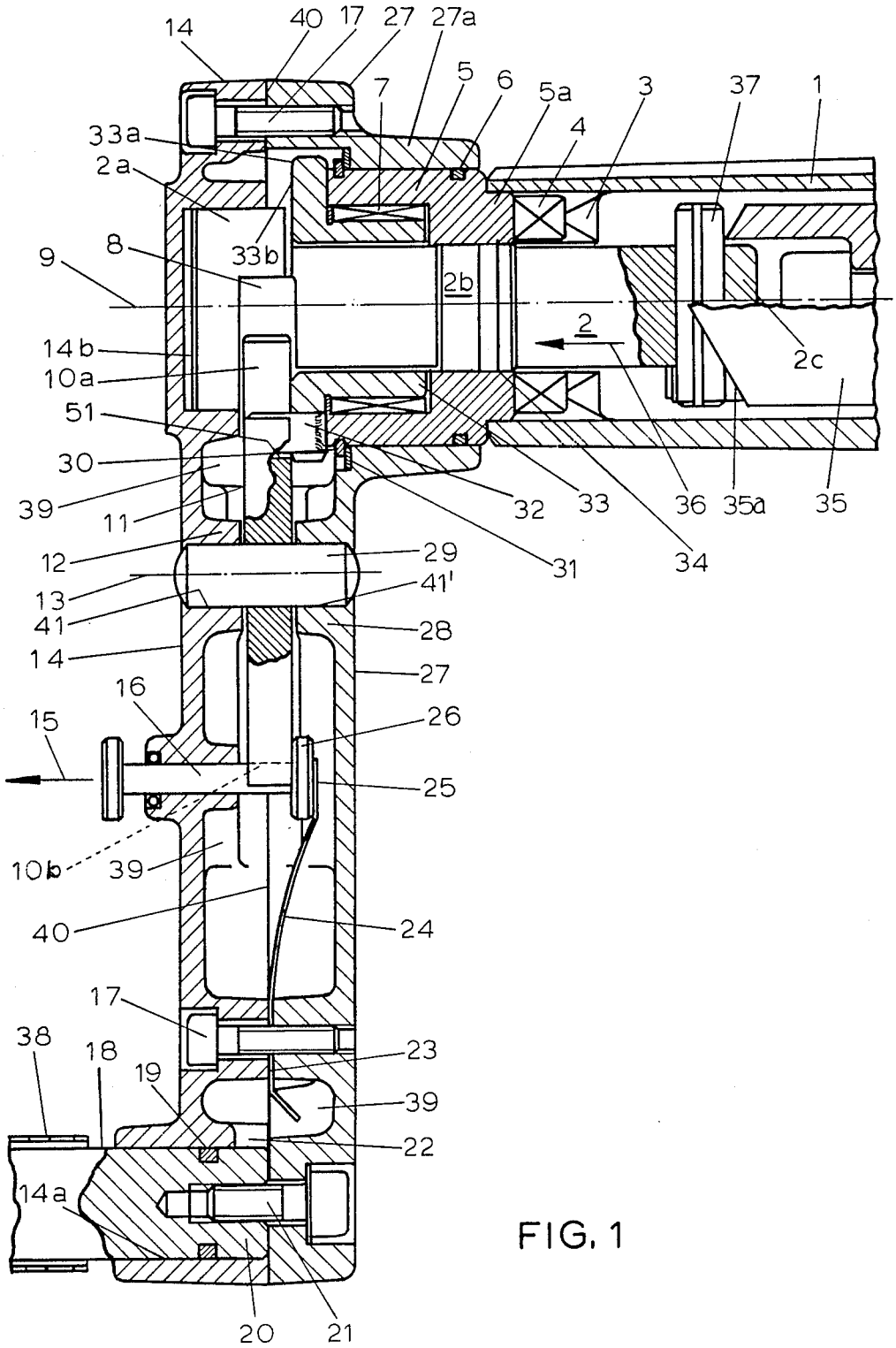
FIG. 1 is a section of a manual starter crank which engages with the cam shaft of an internal combustion engine.

The manual starter crank of this invention has a casing made up of two casing halves 14, 27 which are connected in a fluid-tight manner with one another by cap screws 17. A handle 18 of the manual starter crank is arranged at one end of the predominantly oblong casing of the manual starter crank. The handle 18 includes a shaft 20 with a coaxial grip casing 38 which can be rotated but cannot be displaced axially. One end of the shaft 20 is inserted in an opening 14*a* of the casing half 14 and is perpendicular to the division plane 40 of the casing. A seal 19 about the shaft seals the opening 14*a* in a fluid-tight manner. The shaft 20 is fixed in place by a cap screw 21 which extends through an opening in the casing half 27. An oil feed opening 22 is provided in the casing half 14 at the opening 14*a* and is sealed tight by the sealed shaft 20 inserted in the opening 14*a*. Through the oil feed opening 22, the interior 39 of the casing of the manual starter crank is at least partially filled with oil before inserting the shaft 20. Thus the safety device within the casing of the manual starter crank is lubricated thereby assuring the operability and long service life of the safety device.

The safety device includes a ratchet 11 which is pivotable about a pivot axis 13 transverse to the division plane 40 at the junction of the casing halves 14, 27. The pivot axis 13 is the axis of a pin 29, the ends of which are press fit in aligned bores 41, 41' of the casing halves 14, 27. The ratchet 11 is kept in its axial position on the pin 29 by internal casing projections or pedestals 12, 28. The sides of the pedestals 12, 28 confronting the ratchet 11 are machined and finished to permit free pivoting of the ratchet 11 in the division plane 40 of casing halves 14, 27 about the pivot axis 13. A washer can be placed on the pin 29 between each of the pedestals 12, 28 and the ratchet.

On the ends of the casing halves 14, 27 opposite the handle 18, a starter shaft 2 is mounted whose rotation axis 9 is substantially perpendicular to the division plane 40. The starter shaft 2 has an enlarged diameter end section 2*a* which is rotatably supported along its total axial length in a cylindrical pocket 14*b* of the casing half 14 in the interior 39 of the casing of the manual starter crank. In addition, the middle section 2*b* of the starter shaft 2 is rotatably supported in a bearing support 5 and includes a seal 34 which guarantees a fluid-tight closure between the rotatable starter shaft 2 and the bearing support 5. The other end 2*c* of the starter shaft supports a transverse pin 37 which is perpendicular to the starter shaft axis 9 and whose ends are drivingly engageable with a jaw clutch or coupling 35*a* on the free end of the cam shaft 35. When the starter shaft 2 is rotated in the starting direction, the free ends of pin 37 drivingly engage surfaces on the end of the cam shaft extending generally parallel to the axis 19. Upon starting of the engine, the free ends of the pin 37 are engaged by diagonal surfaces of the coupling 35*a* which displace the starter shaft 2 axially from the coupling 35*a* and thus the crank is disengaged from the cam shaft 35.

The free end of cam shaft 35 is surrounded by a cylindrical housing part 1 of the internal combustion engine whereby the cylindrical part extends approximately to the middle section 2*b* of starter shaft 2. The bearing support 5 has a reduced diameter portion 5*a*, the outer diameter of which corresponds to the inner diameter of the cylindrical housing part 1 whereby it can be slid axially into the engine housing part 1. Axial projections 4 on the bearing support 5 engage pockets 3 in the housing part 1 in the manner of a spline connection, whereby the bearing support 5 is nonrotatably connected with internal combustion engine housing part 1 during a cranking operation.

The casing half 27 is rotatably connected to the bearing support 5. A seal 6 on the outer circumference of the bearing support 5 guarantees a fluid-tight seal between the casing half 27 and the bearing support 5. In order to ensure a secure support for the casing of the manual starter crank and also for the bearing support 5, the casing half 27 has a cylindrical portion 27*a* which extends axially along substantially the entire axial length of the bearing support 5.

The end of the bearing support 5 inside the casing is secured with a snap ring 30 in a groove in the outer circumference of the bearing support 5 and a thrust washer 31 is provided between the snap ring 30 and a flat annular surface of the casing half 27.

A coaxial arrangement of starter shaft 2 with cam shaft 35 is ensured by the cylindrical axial portion 5*a* of the bearing support 5 which has a close fit with the cylindrical engine casing part 1. The bearing support 5, which is held stationary but axially detachable by the projections 4 and pockets 3, forms the firm support for the manual starter crank, and is the pivot bearing about which the casing of the manual starter crank can be rotated.

The bearing support 5 includes an annular chamber which opens axially into the interior 39 of the casing, in which a disengaging bushing 33 is disposed in surrounding relation to the starter shaft 2 with a small clearance. The clearance provided between the disengaging bushing 33 and the starter shaft 2 guarantees that there is no power transmitting connection which could lead to damage to the one-way clutch next described. A one-way clutch 7 is provided between the bearing support 5 and disengaging bushing 33, the latter being free to rotate in the starting direction (FIG. 2) relative to the bearing support but being locked against rotation in the opposite direction. The axial depth of the annular chamber in the bearing support is the same as the axial length of the one-way clutch 7. The disengaging bushing 33 has a radially outward extending annular flange 33*a* at its inner end, the outer diameter of which is greater than the outer diameter of bearing support 5. The annular flange 33*a* is abutted on one axial side by an axially facing surface on the inner end of the bearing support 5, while the surface 33*b* which faces the casing half 14 is in axial bearing relation to an axial facing annular surface of the enlarged end section 2*a* of starter shaft 2. In this way, bearing support 5 is supported in the casing in one axial direction by locking ring 30 and casing half 27 and in the other axial direction by the annular flange 33*a* of the disengaging bushing 33, the end 2*a* of the starter shaft 2 and the casing half 14.

A disengaging pin 32 is secured to the annular flange 33*a* and projects into the path of movement of ratchet 11. The disengaging pin 32 is approximately perpendicular to the division plane 40.

Figure 2:
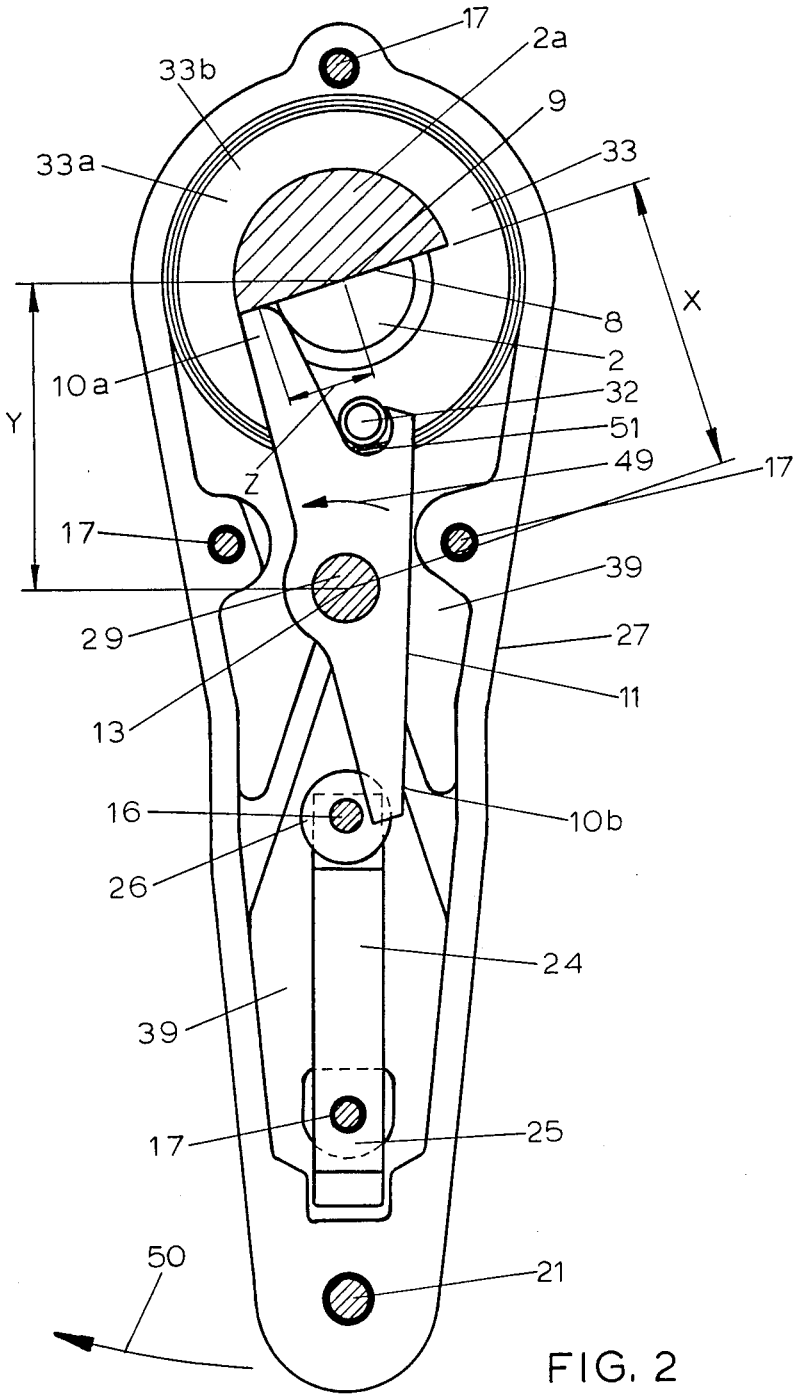
FIG. 2 is a section along the length of the plane of division of the casing of the manual starter crank with a rachet shown in its engaged position.
Figure 3:
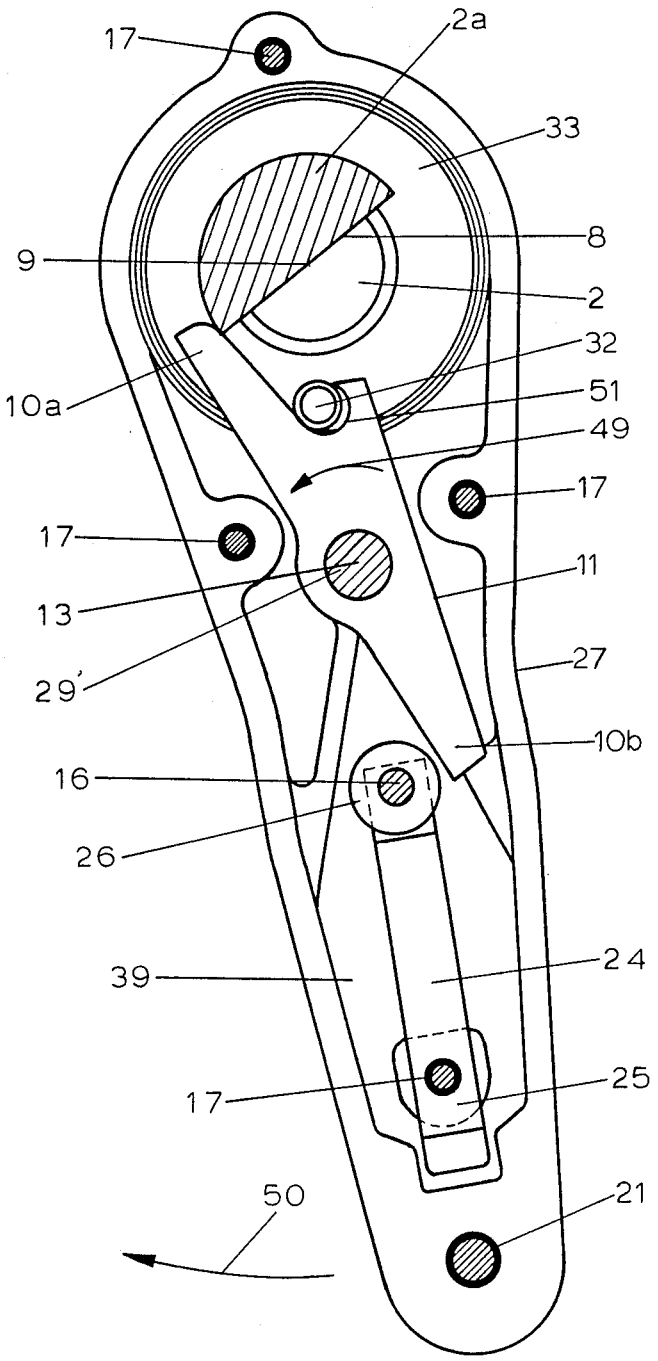
FIG. 3 is a section similar to FIG. 2 but showing a disengaged ratchet.

One free end 10*a* of the ratchet 11 is in adjacent confronting relation to the abutment surface 8 of the starter shaft 2. The abutment surface 8, as can be seen in detail in FIGS. 2 and 3, is a planar surface in which the axis of rotation 9 of starter shaft 2 is located. The abutment surface 8 is preferably formed by the base of a radial groove formed in the end section 2*a* of starter shaft 2. The groove has an axial width which corresponds to approximately half the axial length of the end section 2*a*, whereby one face of the groove is located approximately in the plane of the axially inward facing surface of end section 2*a* which faces in the direction of the bearing support 5. As illustrated in FIGS. 2 and 3, the depth of the groove is such that a semicircle of end section 2*a* remains standing diametrically opposite the groove.

The other end 10*b* of the ratchet 11 is located in the path of movement of a safety actuator 16 which is arranged perpendicularly with respect to the division plane 40 with a stop flange 26 inside the casing secured to a pin portion of the actuator 16. The safety actuator 16 is fluid-tight in a borehole of the casing half 14 and is biased by a pre-stressed laminated leaf spring 24 in an axially outward direction indicated by the arrow 15. The resilient laminated spring is secured at one end 23 between the two casing halves 14 and 27 by a cap screw 17 which also secures the halves 14, 27 together. The other end 25 of the spring 24 engages the flat axial end of the stop flange 26. Since, in the locking position of the ratchet 11 shown in FIG. 2, the end 25 of the spring 24 resiliently biasing the stop flange 26 is located outside the division plane 40, the laminated spring 24 is prestressed.

In the locking position of the ratchet 11 shown in FIG. 2, the free end 10*a* of the ratchet 11 is in confronting engageable relation to the abutment surface 8. The center of the abutting end 102 is located a distance Z from the axis 9. In the illustrated embodiment, the distance Z corresponds approximately to the radius of end section 2*a* of starter shaft 2. The pivot pin 29 of ratchet 11 is positioned between handle 18 and the starter shaft 2 in such a way that the pivot axis 13 is a distance Y from axis of rotation 9 of the starter shaft, which is greater than clearance X from the free end 10*a* of the ratchet 11 to its pivot axis 13. On the basis of the described abutment of the ratchet 11 at the abutment surface 8, the manual starter crank is connected in torque transmitting relation with the starter shaft 2 by the safety device when the crank is rotated in the starting direction 50. The internal combustion engine can therefore be started by rotating the manual starter crank in the starting direction 50. If the internal combustion engine starts running in the starting direction 50, the cam shaft 35 overspeeds the starter shaft 2, whereby the pin 37 rides on the diagonal surface of the coupling 35*a* and moves in the direction of the arrow 36 and out of engagement with the coupling 35*a*, thus disengaging from the cam shaft 35. The total assembly of the manual starter crank with its bearing support 5 and starter shaft 2 can be removed axially from the cylindrical engine casing part 1.

If a backfiring of the internal combustion engine occurs during cranking, the coupling 35*a* between cam shaft 35 and starter shaft 2 cannot function. Backfiring causes transmission of torque in a direction opposite to the starting direction. Thus torque is transmitted to starter shaft 2 and thus via the ratchet to the manual starter crank (since the ratchet is connected in power transmission with the shaft 2 as shown in FIG. 2) and attempts to rotate the crank in a direction opposite to the starting direction 50.

At the beginning of the backfiring induced movement of the casing of the manual starter crank in the direction opposite to the starting direction 50, the disengaging pin 32 also engages the ratchet since disengaging pin 32 is located in the recess or indentation 51 of the ratchet 11. The one-way clutch 7 locks the disengaging bushing 33 and its disengaging pin 32 to the engine part 1 by way of the bearing support 5. With the disengaging pin 32 held stationary and the starting crank moving in a direction opposite to the starting direction 50, the disengaging pin bears against the ratchet 11 causing the ratchet 11 to rotate about its axis 13 in the direction of the arrow 49, whereby its free end 10*a* shifts away from the abutment surface 8 and releases starter shaft 2. The cam shaft 35 of the backfiring engine can thus engage the starter shaft 2 in the direction opposite to the starting direction 50 without rotating the manual starter crank, thus avoiding danger to the operator.

As soon as ratchet 11 is disengaged from the starter shaft 2 by the ratchet bearing against the disengaging pin 32, as shown in FIG. 3, the free end 10*b* of the ratchet 11 shifts out of the path of movement of the stop flange 26. When this occurs, the stop flange 26, under the biasing force of the resilient leaf spring 24, moves into the plane of movement of ratchet 11. The diameter of the stop flange 26 is of such a predetermined dimension that the ratchet 11 can no longer be moved from its disengaged position shown in FIG. 3 to its engaged position shown in FIG. 2. In order to reset the ratchet 11 in its locking or engaged position (FIG. 2), the safety actuator 16 must be depressed by the operator in a direction opposite to the direction indicated by the arrow 15 so as to shift the stop flange 26 out of the path of movement of the ratchet 11.

The movement sequence during engine backfiring, described in detail above, occurs in actual practice in a fraction of a second, so that the possibility of any danger to the operator is excluded.

Upon rotating the manual starter crank in a starting direction 50, the disengaging pin 32, which is trapped in recess 51 in the ratchet 11, moves in the direction opposite to the direction of the arrow 49, thus resetting the ratchet in its engaged position. Minimal energy is required to rotate the disengaging bushing 33 in the free wheeling direction of the one-way clutch 7 to thus shift the ratchet 11 to its engaged position. In the case of engagement of the ratchet 11 in its engaged or engine starting position (FIG. 2), the pin portion of the safety actuator 16 serves, in addition, as the stop for the end 10*b* of ratchet 11, since the free end 10*b* of the ratchet 11 cannot swing about its axis 13 inwards too far in the direction opposite the arrow 49 toward the axis of rotation 9. Thus a distance Z is always guaranteed between axis of rotation 9 and the abutting surface on the free end 10*b*. If the ratchet 11 is again in its cranking position (FIG. 2), the stop flange 26 of the safety actuator 16 will be under resilient bias from the laminated spring 24 and its pin portion will engage the free end 10*b* of ratchet 11. Thus the safety actuator is ready to move to a non-cranking position in the event of another disengagement of the ratchet 11. In the case of small internal combustion engines, it may be advantageous to have the manual starter crank engage the crank shaft.

The coaxial nested arrangement of starter shaft 2, disengaging bushing 33, one-way clutch 7 and bearing support 5 is not only functionally desirable but provides a compact assembly. Without additional machining, the manual starter crank is suitable for internal combustion engines which rotate either to the left or to the right. In order to alter the starter direction, the one-way clutch 7 is turned end for end in the bearing support 5 and the ratchet 11 inserted in the opposite way.

Casing halves 14, 27 are designed advantageously in a symmetrical fashion with respect to a plane through the axes of the cap screw 21 of manual starter crank 18 and the cap screw 17 at the opposite end of the casing.

The embodiments of the invention in which an exclusive property or privilege is claimed are defined as follows:

1. A manual starter crank with an integrated safety device to guard against backfiring during starting of an internal combustion engine having a starter shaft which drivingly engages the free end of a cam shaft of the internal combustion engine when rotated in the starting direction and presenting an abutment surface by which starting torque may be transmitted thereto, said safety device including a ratchet pivotal about a pivot axis substantially parallel to the axis of the starter shaft from a disengaged position to an engaged position in which a free end of said ratchet is in torque transmitting engagement with said abutment surface of said starter shaft, whereby the manual starter crank when turned in said starting direction is drivingly connected for rotating said cam shaft, said safety device further including a bearing support adapted to be held nonrotatable relative to the engine, a disengaging bushing rotatably mounted on said starter shaft, a one-way clutch operatively disposed within said bearing support and between said bearing support and said disengaging bushing allowing rotation of said bushing relative to said bearing support in said starting direction and preventing relative rotation therebetween in the opposite direction and a disengaging pin on said disengaging bushing in the path of pivotal movement of said ratchet and engageable therewith during backfiring of said engine to move said ratchet out of its engaged position and to its disengaged position.

2. The manual starter crank of claim 1 wherein said ratchet includes a recess and said disengaging pin is disposed in said recess, said recess being so constructed and positioned in relation to said disengaging pin that the latter is held in place therein.

3. The manual starter crank of claim 2 wherein said disengaging pin has a rounded part in said recess and said recess extends at least 180 degrees.

4. The manual starter crank of claim 1 wherein said bearing support is adapted to be nonrotatably connected to the housing of the internal combustion engine.

5. The manual starter crank of claim 1 wherein said starter shaft is rotatably supported by said bearing support.

6. The manual starter crank of claim 1 wherein said manual starter crank includes a casing rotatably connected to said bearing support.

7. The manual starter crank of claim 6 and further comprising a handle releasably fastened to said casing and wherein said casing includes an oil feed opening which is closed off by said handle when the latter is fastened to said casing.

8. The manual starter crank of claim 1 wherein said disengaging bushing, one-way clutch and bearing support are coaxial.

9. A manual starter crank with an integrated safety device to guard against backfiring during starting of an internal combustion engine have a starter shaft which drivingly engages the free end of a cam shaft of the internal combustion engine when rotated in the starting direction and presenting an abutment surface by which starting torque may be transmitted thereto, said safety device including a rachet pivotal about a pivot axis substantially parallel to the axis of the starter shaft from a disengaged position to an engaged position in which a free end of said rachet is in torque transmitting engagement with said abutment surface of said starter shaft, whereby the manual starter crank when turned in said starting direction in drivingly connected for rotating said cam shaft, said safety device further including a bearing support adapted to be held nonrotatable relative to the engine, a disengaging bushing rotatably mounted on said starter shaft, a one-way clutch operatively disposed between said bearing support and said disengaging bushing allowing rotation of said bushing relative to said bearing support in said direction and preventing relative rotation therebetween in the opposite direction, a disengaging pin on said disengaging bushing in the path of pivotal movement of said rachet and engageable therewith during backfiring of said engine to move said rachet out of its engaged position and to its disengaged position and a safety actuator shiftable between cranking and noncranking positions, said actuator having a pin portion and a stop flange extending radially from said pin portion, said pin portion lying in the path of movement of said rachet in said cranking position of said actuator whereby said pin portion provides a stop for said rachet when the latter is in its engaged position and said stop flange being operable to hold said rachet in its disengaged position when the latter is moved thereto and said actuator is in its noncranking position.

10. The manual starter crank of claim 9 wherein said stop flange in its noncranking position is in the path of movement of said ratchet further comprising a spring biasing said actuator toward its noncranking position.

11. A manual starter crank with an integrated safety device to guard against backfiring during starting of an internal combustion engine having a starter shaft which drivingly engages the free end of a cam shaft of the internal combustion engine when rotated in the starting direction and presenting an abutment surface by which starting torque may be transmitted thereto, said safety device including a rachet pivotal about a pivot axis substantially parallel to the axis of the starter shaft from a disengaged position to an engaged position in which a free end of said rachet is in torque transmitting engagement with said abutment surface of said starter shaft, whereby the manual starter crank when turned in said starting direction is drivingly connected for rotating said cam shaft, said safety device further including a bearing support adapted to be held nonrotatable relative to the engine, a disengaging bushing rotatably mounted on said starter shaft, a one-way clutch operatively disposed between said bearing support and said disengaging bushing allowing rotation of said bushing relative to said bearing support in said starting direction and preventing relative rotation therebetween in the opposite direction, a recess in said rachet and a disengaging pin on said disengaging bushing disposed in said recess in said rachet and engagable therewith during backfiring of said engine to move said rachet out of its engaging position and to its disengaged position, said recess being so constructed and positioned in relation to said disengaging pin that the latter is held in place therein.

12. A manual starter crank with an integrated safety device to guard against backfiring during starting of an internal combustion engine having a casing and a starter shaft extending from said casing which drivingly engages the free end of a cam shaft of the internal combustion engine when rotated in the starting direction and presenting an abutment surface by which starting torque may be transmitted thereto, said safety device including a rachet pivotally mounted on said casing for pivotal movement about a pivot axis substantially parallel to the axis of the starter shaft from a disengaged position to an engaged position in which a free end of said rachet is in torque transmitting engagement with said abutment surface of said starter shaft, whereby the manual starter crank when turned in said starting direction is drivingly connected for rotating said cam shaft, said safety device further including a bearing support rotatably supporting said casing and adapted to be held nonrotatable relative to the engine, a disengaging bushing rotatably mounted on said starter shaft, a one-way clutch operatively disposed within said casing between said bearing support and said disengaging bushing so as to allow rotation of said bushing relative to said bearing support in said starting direction and to prevent relative rotation therebetween in the opposite direction and a disengaging pin on said disengaging bushing in the path of pivotal movement of said rachet and engageable therewith during backfiring of said engine to move said rachet out of its engaged position and to its disengaged position.

13. The manual starter crank of claim 12 wherein said bearing support is adapted to be nonrotatably connected to the housing of the internal combustion engine.

14. The manual starter crank of claim 12 wherein said starter shaft is rotatably supported by said bearing support.

15. The manual starter crank of claim 12 and further comprising a handle releasably fastened to said casing and wherein said casing includes an oil feed opening which is closed off by said handle when the latter is fastened to said casing.

16. The manual starter crank of claim 12 wherein said disengaging bushing, one-way clutch and bearing support are coaxial.

* * * * *

UNITED STATES PATENT OFFICE

CERTIFICATE OF CORRECTION

Patent No. 4,716,868 Dated January 5, 1988

Inventor(s) Harald Reuter

It is certified that error appears in the above-identified patent and that said Letters Patent are hereby corrected as shown below:

Column 8, line 12, "in" should read "is";
Column 8, line 64, "engaging" should read "engaged";
Column 9, line 21, "and" should be inserted between "casing" and "between".

Signed and Sealed this

Thirty-first Day of May, 1988

*Attest:*

*Attesting Officer*

DONALD J. QUIGG

*Commissioner of Patents and Trademarks*